US006072384A

United States Patent [19]

Baker

[11] Patent Number: 6,072,384

[45] Date of Patent: Jun. 6, 2000

[54] BED WETTING PREVENTION SYSTEM

[76] Inventor: Adrian D. Baker, 14023 Fairwood Breeze, Cypress, Tex. 77429

[21] Appl. No.: 09/286,504

[22] Filed: Apr. 6, 1999

[51] Int. Cl.[7] ..... G08B 1/00

[52] U.S. Cl. ..... 340/309.15; 340/539; 340/604; 340/605; 368/63; 368/108

[58] Field of Search ..... 340/604, 605, 340/309.15, 539; 368/63, 72, 108, 109

[56] References Cited

U.S. PATENT DOCUMENTS

| | | | |
|---|---|---|---|
| 3,778,570 | 12/1973 | Shuman | 200/61.05 |
| 4,234,944 | 11/1980 | Komaki et al. | 368/72 |
| 4,271,406 | 6/1981 | Wilson | 340/604 |
| 4,316,273 | 2/1982 | Jetter | 368/47 |
| 4,347,503 | 8/1982 | Uyehara | 340/604 |
| 4,356,479 | 10/1982 | Wilson | 340/604 |
| 4,800,370 | 1/1989 | Vetecnik | 340/573 |
| 5,119,072 | 6/1992 | Hemingway | 340/573 |
| 5,144,284 | 9/1992 | Hammett | 340/573 |
| 5,294,915 | 3/1994 | Owen | 340/539 |
| 5,341,127 | 8/1994 | Smith | 340/604 |
| 5,489,893 | 2/1996 | Jo et al. | 340/686 |
| 5,554,967 | 9/1996 | Cook et al. | 340/309.15 |

*Primary Examiner*—Jeffery A. Hofsass
*Assistant Examiner*—Phung Nguyen
*Attorney, Agent, or Firm*—Joseph N. Breaux

[57] ABSTRACT

A system for assisting in the prevention of bed wetting. The bed wetting prevention system includes a device that produces an alarm to wake the child at intervals during the night. The alarm device is only deactivatable at a remote location, such as the bathroom.

1 Claim, 3 Drawing Sheets

10
14
12
18
20
22
23
16

BED WETTING PREVENTION SYSTEM

TECHNICAL FIELD

The present invention relates to bed wetting prevention devices and methods and more particularly to a bed wetting prevention system that includes a count down timer/transmitter unit, a user message recording receiver alarm output unit, and a reset timer/transmitter unit magnetic ring; the count down timer/transmitter unit including a radio transmitter controlled by a transmitter circuit in connection with a countdown timer circuit connected to an interval set mechanism and an interval reset mechanism; the interval set mechanism including a set time interval select switch, an hour set switch, a minute set switch, and an elapsed time display; the interval reset mechanism including a magnetically actuated reset enable switch in connection with the timer control circuit and a reset timer button; the user message recording receiver alarm output unit including a recording/playback mechanism in connection with a radio receiver circuit such that the playback mechanism is activated by a signal from the radio receiver circuit; the recording playback mechanism including a record activation button and a record/playback circuit including a microphone and a speaker.

BACKGROUND ART

It is often difficult for some children to not wet the bed. It would be a benefit to these children, to have a device that could wake them up at intervals during the night to use the restroom and, thereby, help to prevent bed wetting. Although waking the child may work to assist some children in walking to the bathroom each time woken, it would be a further benefit to have a device that included an alarm device that was only deactivatable at a remote location, such as the bathroom, that required the child to actually get out of bed and enter the bathroom to silence the alarm.

GENERAL SUMMARY DISCUSSION OF INVENTION

It is thus an object of the invention to provide a bed wetting prevention system that includes a device that produces an alarm to wake the child at intervals during the night.

It is a further object of the invention to provide a bed wetting prevention system that includes a device that includes an alarm device that is only deactivatable at a remote location, such as the bathroom.

It is a still further object of the invention to provide a bed wetting prevention system that includes a count down timer/transmitter unit, a user message recording receiver alarm output unit, and a reset timer/transmitter unit magnetic ring; the count down timer/transmitter unit including a radio transmitter controlled by a transmitter circuit in connection with a countdown timer circuit connected to an interval set mechanism and an interval reset mechanism; the interval set mechanism including a set time interval select switch, an hour set switch, a minute set switch, and an elapsed time display; the interval reset mechanism including a magnetically actuated reset enable switch in connection with the timer control circuit and a reset timer button; the user message recording receiver alarm output unit including a recording/playback mechanism in connection with a radio receiver circuit such that the playback mechanism is activated by a signal from the radio receiver circuit; the recording playback mechanism including a record activation button and a record/playback circuit including a microphone and a speaker.

It is a still further object of the invention to provide a bed wetting prevention system that accomplishes all or some of the above objects in combination.

Accordingly, a bed wetting prevention system is provided. The bed wetting prevention system includes a count down timer/transmitter unit, a user message recording receiver alarm output unit, and a reset timer/transmitter unit magnetic ring; the count down timer/transmitter unit including a radio transmitter controlled by a transmitter circuit in connection with a countdown timer circuit connected to an interval set mechanism and an interval reset mechanism; the interval set mechanism including a set time interval select switch, an hour set switch, a minute set switch, and an elapsed time display; the interval reset mechanism including a magnetically actuated reset enable switch in connection with the timer control circuit and a reset timer button; the user message recording receiver alarm output unit including a recording/playback mechanism in connection with a radio receiver circuit such that the playback mechanism is activated by a signal from the radio receiver circuit; the recording playback mechanism including a record activation button and a record/playback circuit including a microphone and a speaker.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
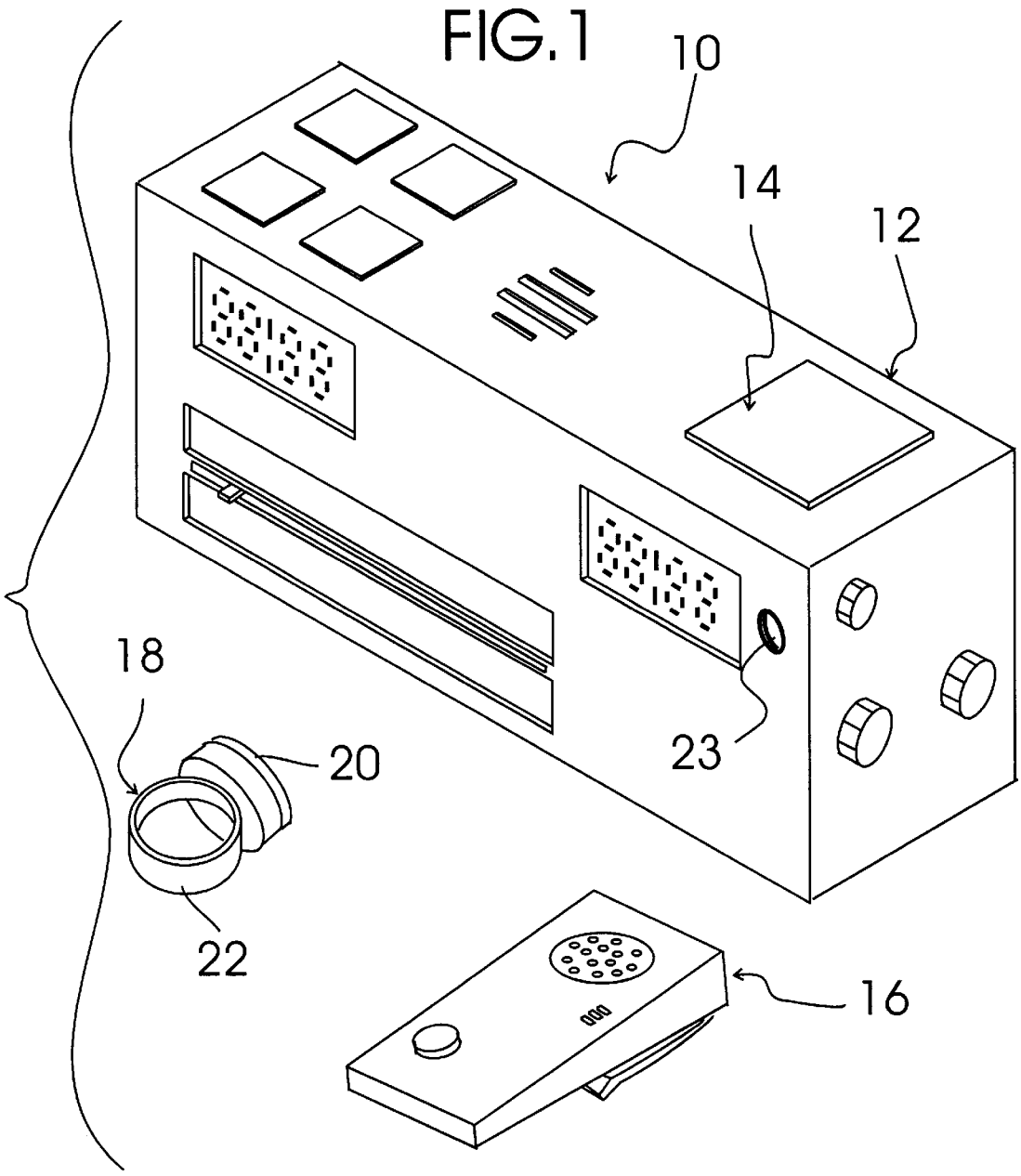
FIG. 1 is a perspective view of an exemplary embodiment of the bed wetting prevention system of the present invention showing the count down timer/transmitter unit; the user message recording receiver alarm output unit; and the reset timer/transmitter unit magnetic ring; the count down timer/transmitter unit including a radio transmitter controlled by a transmitter circuit in connection with a countdown timer circuit connected to an interval set mechanism and an interval reset mechanism; the interval set mechanism including a set time interval select switch, an hour set switch, a minute set switch, and an elapsed time display; the interval reset mechanism including a magnetically actuated reset enable switch in connection with the timer control circuit and a reset timer button; the user message recording receiver alarm output unit including a recording/playback mechanism in connection with a radio receiver circuit such that the playback mechanism is activated by a signal from the radio receiver circuit; the recording playback mechanism including a record activation button and a record/playback circuit including a microphone and a speaker.

FIG. 1 shows an exemplary embodiment of the bed wetting prevention system of the present invention generally designated 10. Bed wetting prevention system 10 includes a radio assembly, generally designated 12 having a count down timer/transmitter unit, generally designated 14, provided therein; a user message recording receiver alarm output unit, generally designated 16; and a reset timer/transmitter unit magnetic ring, generally designated 18, that includes a disk shaped magnet 20 attached a ring 22. In this embodiment, the housing of radio assembly 12 is provided with an indentation 23 for receiving disk shaped magnet 20.

Figure 2:
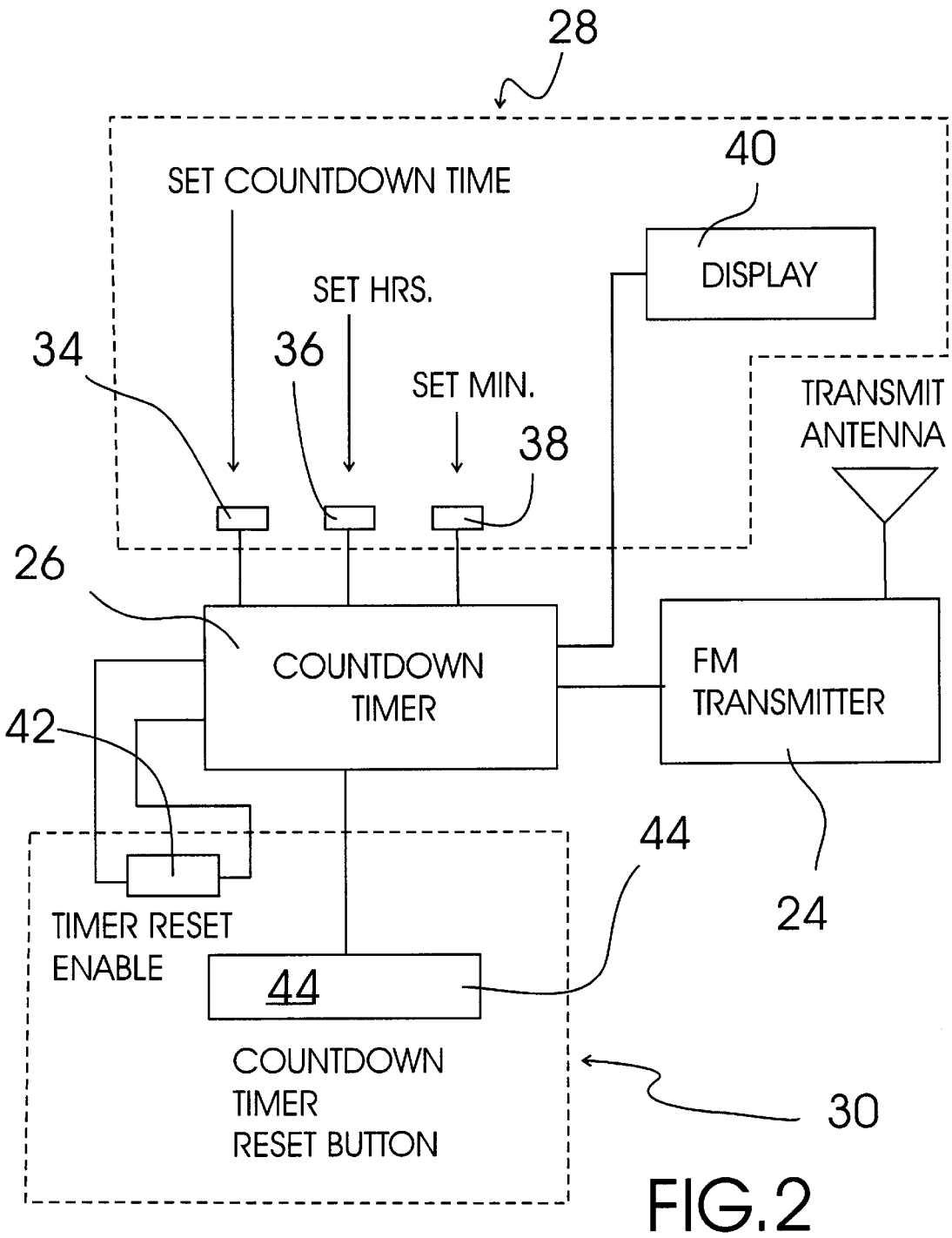
FIG. 2 is a schematic diagram of the count down timer/transmitter unit showing the radio transmitter; the countdown timer circuit; the interval set mechanism in connection with the countdown timer circuit including the set time interval select switch, the hour set switch, the minute set switch, and the seven segment elapsed time display; and the interval reset mechanism in connection with the count down timer circuit including the magnetically actuated reset enable switch and the momentary contact reset timer switch.

With reference to FIG. 2, Count down timer/transmitter unit 14 includes a radio transmitter, generally designated 24, having a transmitter circuit in connection with a countdown timer circuit 26. Count down timer circuit 26 is connected to an interval set mechanism, generally designated 28 (dashed lines), and an interval reset mechanism, generally designated 30 (dashed lines). Interval set mechanism 28 includes a set time interval select switch 34, an hour set switch 36, a minute set switch 38, and an elapsed time display 40. Interval reset mechanism 30 includes a magnetically actuated reset enable reed switch 42 in connection with timer control circuit 26 and a reset timer button switch 44. Reed switch 42 is positioned adjacent to indentation 23 (FIG. 1).

Figure 3:
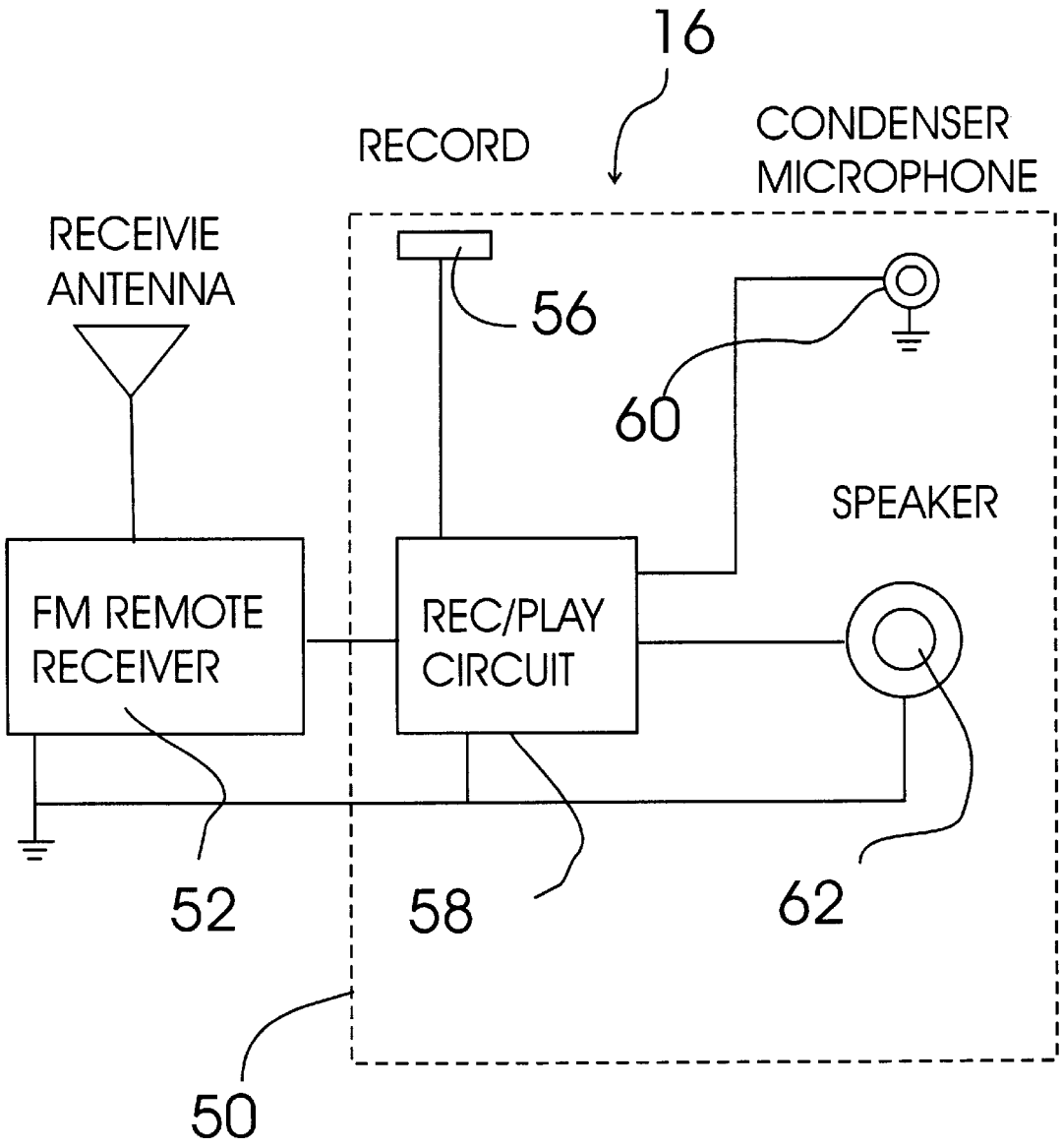
FIG. 3 is a schematic diagram of the user message recording receiver alarm output unit showing the radio receiver circuit; the record activation button; and the record/playback circuit in connection with the radio receiver circuit and the record activation button.

With reference to FIG. 3, user message recording receiver alarm output unit 16 includes a recording/playback mechanism, generally designated 50, in connection with a radio receiver circuit 52 such that recording/playback mechanism 50 is activated by a signal from radio receiver circuit 52. The recording/playback mechanism 50 includes a record activation button 56, a record/playback circuit 58, a microphone 60 and a speaker 62.

It can be seen from the preceding description that a bed wetting prevention system has been provided that includes a device that produces an alarm to wake the child at intervals during the night; that includes a device that includes an alarm device that is only deactivatable at a remote location, such as the bathroom; and that includes a count down timer/transmitter unit, a user message recording receiver alarm output unit, and a reset timer/transmitter unit magnetic ring; the count down timer/transmitter unit including a radio transmitter controlled by a transmitter circuit in connection with a countdown timer circuit connected to an interval set mechanism and an interval reset mechanism; the interval set mechanism including a set time interval select switch, an hour set switch, a minute set switch, and an elapsed time display; the interval reset mechanism including a magnetically actuated reset enable switch in connection with the timer control circuit and a reset timer button; the user message recording receiver alarm output unit including a recording/playback mechanism in connection with a radio receiver circuit such that the playback mechanism is activated by a signal from the radio receiver circuit; the recording playback mechanism including a record activation button and a record/playback circuit including a microphone and a speaker.

It is noted that the embodiment of the bed wetting prevention system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A bed wetting prevention system comprising:

a count down timer/transmitter unit; and a user message recording receiver alarm output unit;

said count down timer/transmitter unit including a radio transmitter controlled by a transmitter circuit in connection with a countdown timer circuit connected to an interval set mechanism and an interval reset mechanism;

said interval set mechanism including a set time interval select switch, an hour set switch, a minute set switch, and an elapsed time display;

said interval reset mechanism including a reset timer button;

said user message recording receiver alarm output unit including a recording/playback mechanism in connection with a radio receiver circuit such that said playback mechanism is activated by a signal from said radio receiver circuit;

said recording playback mechanism including a record activation button and a record/playback circuit including a microphone and a speaker;

said bed wetting prevention system further including a reset timer/transmitter unit magnetic ring;

said interval reset mechanism further including a magnetically actuated reset enable switch in connection with said timer control circuit for enabling said reset timer button;

said reset timer/transmitter unit magnetic ring being of sufficient magnetic strength to actuate said magnetically actuated reset enable switch.

* * * * *